United States Patent [19]

West

[11] Patent Number: 4,922,067

[45] Date of Patent: May 1, 1990

[54] FLUID PRESSURE SWITCH HAVING VENTING MEANS FOR DISPERSING BACK PRESSURE

[75] Inventor: Henry L. West, Rochester, N.Y.

[73] Assignee: Eastman Kodak Company, Rochester, N.Y.

[21] Appl. No.: 176,538

[22] Filed: Apr. 1, 1988

[51] Int. Cl.[5] ..... H01H 35/34

[52] U.S. Cl. ..... 200/83 P; 200/86 R

[58] Field of Search ..... 200/51 R, 81, 4, 81 R, 200/85 R, 86 R, 83 P, 83 R, 83 N, 83 Q, 83 W, 159 B; 307/118; 361/414

[56] References Cited

U.S. PATENT DOCUMENTS

| | | | |
|---|---|---|---|
| 3,267,233 | 8/1966 | Basile | 200/83 N |
| 3,917,917 | 11/1975 | Murata | 200/83 N |
| 4,066,851 | 1/1978 | White | 200/86 R |
| 4,243,858 | 1/1981 | Place | 200/83 W |
| 4,602,135 | 7/1986 | Phalen | 200/159 B |
| 4,608,465 | 8/1986 | Harada | 200/159 B |

*Primary Examiner*—Gerald P. Tolin

*Attorney, Agent, or Firm*—Edward Dugas

[57] ABSTRACT

The invention is a fluid pressure switch which is particularly adapted for use on a water purifying system of the type wherein incoming water pressure and water pressure in a reservoir are used to activate conditioning electronics. In the preferred switch embodiment, a first flexible nonconducting layer of material is positioned over an orifice connected to a source of incoming water and over an orifice connected to a source of reservoir water. A flexible conducting material is positioned abutting the nonconducting layer over each of the orifices. A second layer of nonconductive material having conductive lines affixed thereto is laminated to the first nonconducting layer, such that fluid pressure deforms the conductive layer into electrical contact with the conductive lines. A semi-rigid backing plate, having air chambers formed therein at the location of each orifice, sealably clamps all of the layers to the body of the water purifier and is connected to the area surrounding the flexible conducting material to minimize the back pressure buildup when the flexible conductive material is deformed by water pressure.

7 Claims, 2 Drawing Sheets

FLUID PRESSURE SWITCH HAVING VENTING MEANS FOR DISPERSING BACK PRESSURE

BACKGROUND OF THE INVENTION

The present invention is directed to fluid pressure switches and more particularly to relatively small metal membrane pressure switches that are conditioned to operate in a fluid environment.

The design of the present switch was driven by a need for a small, simple, inexpensive and highly reliable switch that could be utilized with a water purifying system of the type that incorporates a reservoir for storing filtered water and conductivity probes coupled to electronic circuitry for testing the salinity of the supply and filtered water. The pressure switches are used to enable the electronic circuitry for testing salinity, as well as enabling a display for indicating the existence of the supply and reservoir water pressures.

SUMMARY OF THE INVENTION

The switch of the present invention is designed to interface with at least one orifice of a water purifying system to sense the pressure of the water in the orifice. The switch is comprised of a flexible layer of electrically insulating material sealing the at least one orifice. A disk of flexible conductive material is positioned abutting the flexible insulating layer over the orifice. At least one pair of switch contacts are positioned proximate the disk of flexible conductive material, such that a fluid pressure applied to the orifice deforms the flexible layer of electrically insulating material forcing the disk of flexible conductive material into electrical contact with the pair of switch contacts. A semi-rigid back plate sandwiches the flexible layer of electrical insulating material, the disk of flexible conductive material and the pair of switch contacts to the surface of the water purifying system containing the orifice to provide a waterproof assembly. The semi-rigid back plate has incorporated therein air chambers which are coupled to the area adjacent the flexible conductive material so as to minimize the effect of pressure when the flexible conductive material is deformed into electrical contact with the pair of switch contacts.

In the preferred embodiment of the invention, the flexible conductive material is a metal snap dome having a thickness which is a function of the pressure at which the dome will snap.

Also in the preferred embodiment of the invention, the air chambers formed in the back plate are configured to have supporting material therebetween to minimize the amount of flexing that can be experienced by the pair of switch contacts.

From the foregoing it can be seen that it is a primary object of the present invention to provide an improved membrane type switch.

It is a further object of the present invention to provide a switch with a connected air chamber so as to maintain the switching pressure substantially constant.

It is a further object of the present invention to provide a waterproof membrane type pressure switch.

It is yet another object of the present invention to provide a fluid pressure switch particularly adaptable for use with a water purifying system.

These and other objects of the present invention will become more apparent when taken in conjunction with the following description and drawings wherein like characters indicate like parts and which drawings form a part of the present disclosure.

DESCRIPTION OF THE PREFERRED EMBODIMENTS

Figure 1:
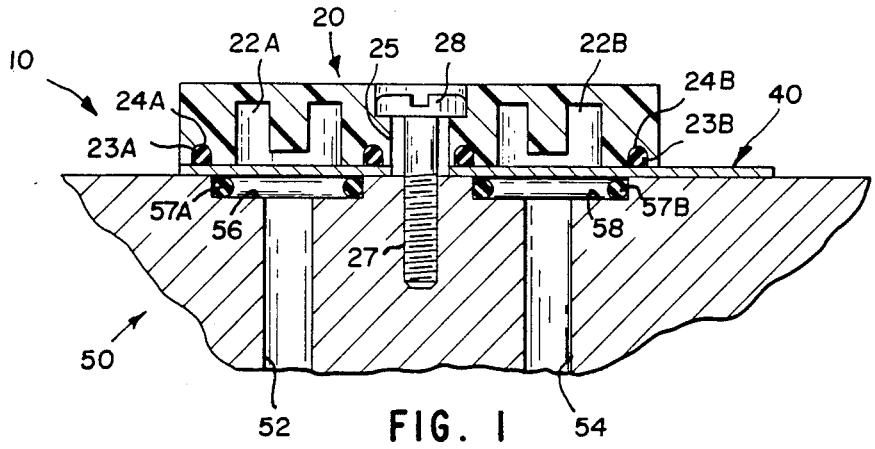
FIG. 1 is a sectioned view of a dual membrane switch assembly according to the present invention shown mounted to a rigid housing containing two fluid orifices.
Figure 3A:
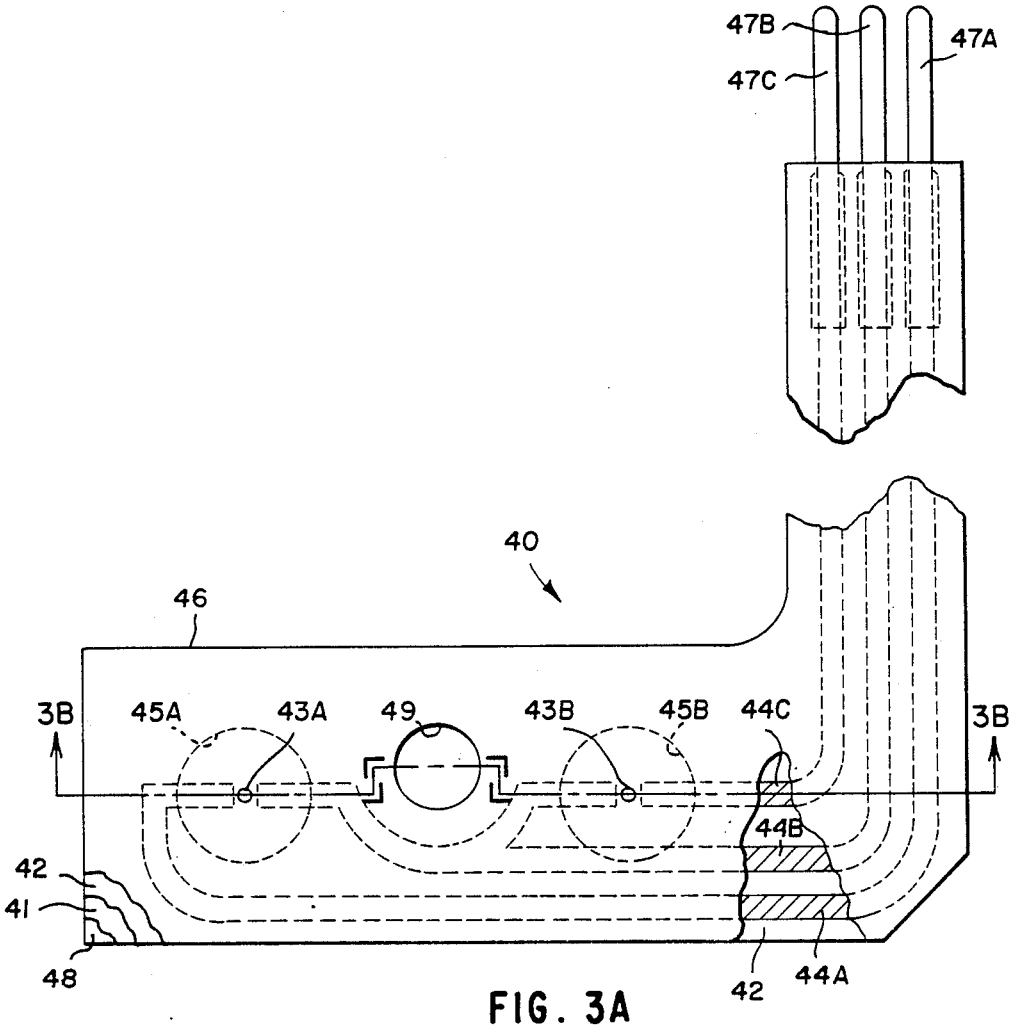
FIG. 3A illustrates, in a partially cutaway top view, the flexible portion of the switch of FIG. 1.
Figure 3B:
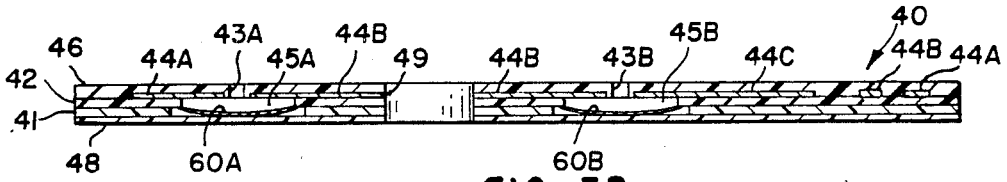
FIG. 3B illustrates a sectioned view, taken along the section lines 3B—3B of FIG. 3A.
Figure 4:
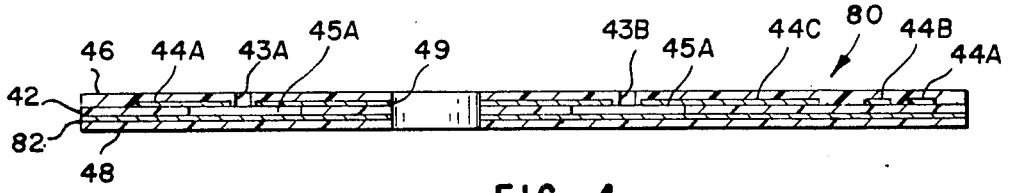
FIG. 4 is a sectioned view, also taken along the section lines 3B—3B of FIG. 3A, illustrating an alternate construction for the internal switching elements.

Referring now to FIG. 1, wherein is shown a dual membrane type switch 10 affixed to a rigid housing 50. Two orifices 52 and 54 are shown passing through the rigid body member 50 emptying into recessed areas 56 and 58, respectively. Positioned in the recessed areas are resilient O-rings 57A and 57B. A membrane type switch sub-assembly 40, which is shown in detail in FIGS. 3A, 3B, and 4, is shown sealed against the recessed areas 56 and 58 by means of a back plate 20 which is fastened to the support body 50 by a machine screw-type fastener 28 engaging threads 27.

The back plate 20 has formed therein sets of air chambers denoted generally as 22A and 22B which chambers are positioned opposite the recessed areas 56 and 58, respectively. The back plate 20 is sealed against the membrane switch sub-assembly 40 by means of O rings 23A and 23B which fit into corresponding recessed grooves 24A and 24B, respectively. The fastener 28 screws into the corresponding threads 27, in the support body 50, with the head of the fastener pressing against the lip which is formed by the juncture of a hole 25 meeting with a larger hole 26.

Fluid under pressure, generally different pressures, fills the orifices 52 and 54 along with the recessed areas 56 and 58. In the preferred embodiment, water is the fluid used but it is appreciated that the switches could also work with air pressure. In operation, the fluid pressure deforms the switch membrane in the area represented by areas 56 and 58 causing the membrane to flex and make electrical contact in a manner to be described in conjunction with the description of FIGS. 3A, 3B, and 4. The deformation, in addition, causes a slight increase in the pressure of the air in the chambers 22A and 22B. If the chambers were not present, the air pressure would be much greater.

Figure 2A:
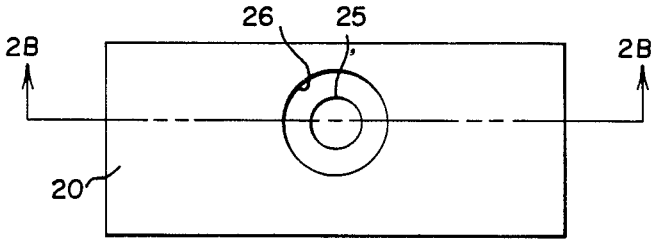
FIGS. 2A, 2B, and 2C are a top view, a sectioned view, and a bottom view, respectively, of a backing plate that is used in the switch assembly of FIG. 1.
Figure 2B:
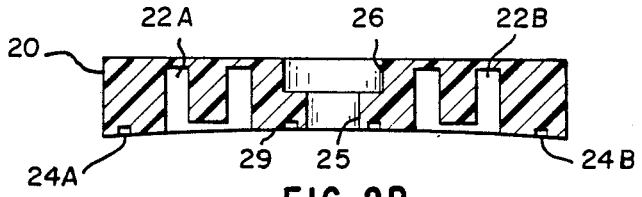
Figure 2C:
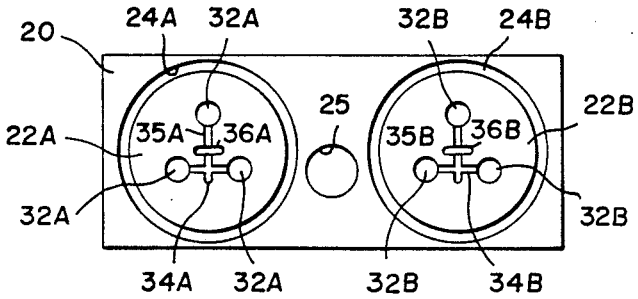

Referring now to FIGS. 2A, 2B, and 2C, the back plate member 20 is formed from a semi-rigid material, such as a plastic with a centrally located mounting fastener hole 25 passing therethrough and engaging a larger recessed hole 26 for providing a lip onto which the machine-type screw can exert a fastening force.

In FIG. 2B specifically illustrative is a bow-like surface 29 formed into the back plate member so as to specifically create an engagement force along the entire length and width of the back plate member when the fastener 28 pulls the back plate member into tight engagement against the membrane switch sub-assembly as shown in FIG. 1.

The air chambers 22A and 22B are more clearly seen in FIG. 2C comprised of two groups of three cylindrical openings 32A and 32B, respectively, with each of the cylinders in a group connected by channel passages 34A, 35A, 36A, and 34B, 35B and 36B. The recessed grooves 24A and 24B are arranged to receive the O-rings 23A and 23B, respectively as previously described. The configuration of the air chambers is designed with a maximum amount of physical material being present behind the membrane switch sub-assembly 40 in the area where deformation of the flexible material takes place due to the fluid pressure in the apertures while still providing a relatively large air chamber. The purpose of this support material is to hold the flexible material containing electrical switch contacts in a relatively rigid position, such that the pressure at which the switches are activated remains substantially constant in spite of many activations.

The cylindrical openings 32, along with the connecting channels, are sufficiently large, such that the compression of the air within these cylinders, by activation of the flexible switch, will raise the air pressure within the chambers approximately 2 PSI. The pressure at which the switch is designed to trip is then fixed at the pressure for a switch that is normally vented to the atmosphere plus an additional 2 PSI.

Referring now to FIGS. 3A and 3B, the membrane switching sub-assembly 40, of the switch 10, in the preferred embodiment is formed of laminations of flexible-type material, such as a plastic. A flexible layer of non-conductive material 46 generally formed in the shape of a reversed "L" is provided with two vent holes 43A and 43B, along with a substantially larger centrally located hole 49. The hole 49 will project through all of the layers to be discussed and is provided for the fastener 28 shown in FIG. 1. Positioned on the innermost major surface of the layer 46 are conductive lines 44A, 44B, and 44C which form the switch contacts. These lines may be metallic or carbon conductors. These lines extend from the areas where the switch contact is made in the handle of the "L". The handle of the "L" is equivalent to a flexible ribbon-like conductor having rigid electrical pin connections 47A, 47B, and 47C physically connected thereto and electrically connected to the conductive lines 44A–C. A second nonconducting layer 42 is laminated to layer 46. Layer 42 has openings therethrough to generally define the areas 45A and 45B. A third electrically insulating layer 41 is laminated to the layer 42 and has openings therethrough with a diameter that is greater than the openings appearing in layer 42. A pair of dome-like metal snaps 60A and 60B, having a diameter and/or width, if noncircular in shape, greater than the opening through layer 42, but less than the diameter of the opening in layer 41 are positioned in the general area of 45A and 45B. Other spring-like conductors can be used to replace the snaps 60A and 60B. A sealing layer of flexible, electrically insulating material, 48 covers the bottom surface of the membrane sub-assembly to provide a fluid proof surface and to retain the snaps 60A and 60B in place.

In operation of the embodiments shown in FIGS. 3A and 3B, it can be seen that a pressure applied to the layer 48 in the vicinity of the areas 45A and/or 45B will cause the flexible layer 48 to deform which in turn will cause the dome snap 60A and/or 60B to deflect and snap completing the circuit path between the conductive lines 44A and 44B and/or 44B and 44C dependent upon which of the domes is deflected. During the deflection process the air filling the space 45A and/or 45B is exited from that area through the vent holes 43A andor 43B, respectively. The air, referencing back to FIG. 1, then enters the air chambers 22A and 22B which chambers are sized to minimize the effect of back pressure on the operation of the snap domes.

Referring now to FIG. 4 which is a second embodiment of the membrane switch sub-assembly 40 which embodiment eliminates the snap domes 60A and 60B and substitutes instead a conductive sheet 82 which is laminated directly onto the layer 42 without the need for a layer 41. In the embodiment of FIG. 4 the conductive layer 82 is a thin, flexible material, such that a pressure on layer 48, in the area of the openings 45A and 45B, will cause the conductive layer, along with the material of layer 48, to deform and project into that area making electrical contact with the conductive lines 44A, 44B, and/or 44C.

As can be appreciated, both for the FIG. 3B embodiment and the FIG. 4 embodiment, undesirable deformations in the flexible layer 46, to which is laminated the conductive lines 44A, is possible without a firm backing surface. The backing surface is provided by the particular configuration of the material between the air chambers 22A and 22B on the backing plate 20. The configuration is such that maximum physical support is provided for preventing deflection of layer 44A while still providing a maximum air chamber for minimizing the effects of pressure when the switch is activated.

While there has been shown what are considered to be the preferred embodiments of the invention, it will be manifest that many changes and modifications may be made therein without departing from the essential spirit of the invention. It is intended, therefore, in the annexed claims to cover all such changes and modifications as may fall within the true scope of the invention.

I claim:

1. A fluid pressure switch comprising:

a first electrically insulating layer having at least one vent hole therethrough;

at least one set of electrical switch conductors affixed to said electrically insulating layer proximate said vent hole;

a second electrically insulating layer sandwiching said electrical switch contacts to said first electrically insulating layer and having at least one opening therethrough in an area where electrical contact with switch conductors is to take place;

a spring-like conductive material positioned over said at least one opening; and a flexible layer of electrically insulating material sandwiching said spring-like conductive material to said second electrically insulating layer and forming a fluid proof seal for said conductive material and said electrical switch conductors, fluid pressure flexing the flexible layer against the spring-like conductive material to cause said conductive material to project into the at least one opening in said second electrically insulating layer to electrically connect said switch conductors, said movement venting air through said at least one vent hole; and a semi-rigid backing plate having at least one air chamber, said backing plate affixed to said first electrically insulating layer with said at least one vent hole aligned with said at least one air chamber to provide a reservoir for displaced air so as to minimize the pressure rise in said air chamber when said spring-like conductive material moves into said at least one opening.

2. A fluid pressure switch according to claim 1 wherein said spring-like conductive material is a disk formed of conductive material.

3. A fluid pressure switch according to claim 1 wherein said spring-like conductive material is a thin sheet of material.

4. A fluid pressure switch according to claim 1 wherein said semi-rigid backing plate is bowed in the area surrounding said at least one air chamber so as to provide a fluid-proof seal when said backing plate is used to sandwich said first, said second and said flexible layer against the surface of a fluid pressure outlet.

5. A switch comprising:

a first flexible nonconducting layer;

a first semi-rigid nonconducting layer laminated to said flexible nonconducting layer and having at least one defined opening therethrough;

a metal snap dome positioned in said at least one defined opening;

a second semi-rigid nonconducting layer laminated to said first semi-rigid nonconducting layer and having at least one defined opening therethrough smaller in size than said snap dome so as to retain said snap dome;

a second layer of flexible nonconducting material having conductive lines affixed thereto and laminated to said second semi-rigid nonconducting layer such that depression of said metal snap dome causes an electrical contact between at least two conductive lines, and having vent openings through said second layer of flexible nonconducting material with said vent openings coupled to the defined openings for dispersing the pressure created when said metal snap dome is depressed.

6. A switch according to claim 5 and further comprising: vented air chamber means positioned over said vent openings abutting said second layer of flexible nonconducting material and comprises a rigid body having a plurality of interconnected air chambers with sections of rigid material therebetween for preventing flexure of said second layer of flexible nonconducting material when said snap dome is depressed.

7. A switch according to claim 7 wherein said vented air chamber means is formed with one surface prebowed such that a fastener positioned through the center thereof creates a force sufficient to flaten said prebowed surface sealably against said second layer of flexible nonconducting material.

* * * * *